US006179879B1

(12) United States Patent
Robinson et al.

(10) Patent No.: US 6,179,879 B1
(45) Date of Patent: Jan. 30, 2001

(54) LEATHER IMPREGNATED WITH TEMPERATURE STABILIZING MATERIAL AND METHOD FOR PRODUCING SUCH LEATHER

(75) Inventors: Douglas K. Robinson, Mansfield; John J. Erickson, Brockton, both of MA (US); Michael Redwood, Somerton (GB)

(73) Assignee: Acushnet Company, Fairhaven, MA (US)

( * ) Notice: Under 35 U.S.C. 154(b), the term of this patent shall be extended for 0 days.

(21) Appl. No.: 09/275,452

(22) Filed: Mar. 24, 1999

(51) Int. Cl.[7] ..... C14C 9/00; A43B 7/34

(52) U.S. Cl. ..... 8/94.21; 8/94.19 R; 428/540; 36/43; 36/83; 36/98; 36/127

(58) Field of Search ..... 8/94.19 R, 94.21, 8/94.33; 428/540; 36/83, 43, 127, 98

(56) References Cited

U.S. PATENT DOCUMENTS 2,694,606 11/1954 Etzkorn .
2,785,086 3/1957 Strobino .
3,493,460 2/1970 Windecker .
3,852,401 12/1974 Suzuki et al. .
4,048,359 9/1977 Shibanai et al. .
4,226,906 10/1980 Jacob .
4,230,808 10/1980 Pietersen .

(List continued on next page.)

FOREIGN PATENT DOCUMENTS

WO 95/34609 12/1995 (WO) .
95/34609 * 12/1995 (WO) .

*Primary Examiner*—Margaret Einsmann
(74) *Attorney, Agent, or Firm*—Pennie & Edmonds LLP

(57) ABSTRACT

The present invention is directed towards a tanned leather product that is impregnated with a plurality of microspheres containing a temperature stabilizing material. The present invention is also directed to a tanning process for embedding the microspheres into the leather. The thermal stabilizing material is a phase change material that allows the leather to have enhanced thermal properties when exposed to heat or cold.

16 Claims, 5 Drawing Sheets

U.S. PATENT DOCUMENTS

| | | |
|---|---|---|
| 4,273,825 | 6/1981 | Nishiyama et al. . |
| 4,296,174 | 10/1981 | Hanzel et al. . |
| 4,428,998 | 1/1984 | Hawkinson . |
| 4,441,508 | 4/1984 | Buirley et al. . |
| 4,457,460 | 7/1984 | Hirsch et al. . |
| 4,470,917 | 9/1984 | Hawe et al. . |
| 4,510,188 | 4/1985 | Ruggeri . |
| 4,513,106 | 4/1985 | Edgren et al. . |
| 4,514,461 | 4/1985 | Woo . |
| 4,524,529 | 6/1985 | Schaefer . |
| 4,528,226 | 7/1985 | Sweeny . |
| 4,561,981 | 12/1985 | Characklis . |
| 4,572,864 | 2/1986 | Benson et al. . |
| 4,581,286 | 4/1986 | Föttinger et al. . |
| 4,605,586 | 8/1986 | Lane . |
| 4,609,587 | 9/1986 | Giordano et al. . |
| 4,623,583 | 11/1986 | Mischutin . |
| 4,659,619 | 4/1987 | Tate . |
| 4,675,161 | 6/1987 | Hashimoto et al. . |
| 4,681,791 | 7/1987 | Shibahashi et al. . |
| 4,751,116 | 6/1988 | Schaefer et al. . |
| 4,756,958 | 7/1988 | Bryant et al. . |
| 4,807,696 | 2/1989 | Colvin et al. . |
| 4,911,232 | 3/1990 | Colvin et al. . |
| 4,923,732 | 5/1990 | Schaefer . |
| 5,141,079 | 8/1992 | Whitney et al. . |
| 5,224,356 | 7/1993 | Colvin et al. . |
| 5,290,904 | 3/1994 | Colvin et al. . |
| 5,366,801 | 11/1994 | Bryant et al. . |
| 5,415,222 | 5/1995 | Colvin et al. . |
| 5,499,460 | 3/1996 | Bryant et al. . |
| 5,532,039 | 7/1996 | Payne et al. . |
| 5,637,389 | 6/1997 | Colvin et al. . |
| 5,677,048 | 10/1997 | Pushaw . |
| 5,708,979 | 1/1998 | Redwood et al. . |
| 5,722,482 | 3/1998 | Buckley . |
| 5,759,706 | 6/1998 | Widdemer . |
| 5,763,335 | 6/1998 | Hermann . |
| 5,804,297 | 9/1998 | Colvin et al. . |
| 5,811,122 | 9/1998 | Schlup et al. . |

* cited by examiner

LEATHER IMPREGNATED WITH TEMPERATURE STABILIZING MATERIAL AND METHOD FOR PRODUCING SUCH LEATHER

TECHNICAL FIELD

The present invention relates generally to leather and leather products, and more particularly to leather impregnated with microspheres containing a temperature stabilizing material, and a method for tanning the microspheres into leather.

BACKGROUND OF THE INVENTION

Tanning is a very old art, which is a treatment for preventing the decomposition of raw hides or skins. The tanned raw hides, typically referred to as leather, are also flexible and very strong. Originally, tanning was accomplished by using vegetable tanning agents such as bark, leaf, or bean extracts. Bark extracts used include for example those that can be obtained from oak, hemlock or avaram trees. Leaf extracts used include those that can be obtained from for example sumac. Bean extracts can be obtained for example from the acacia tree.

Mineral tanning agents or tannins have gradually replaced vegetable tanning agents, because mineral tanning agents produce stronger and more flexible leathers from the raw skins. Of the mineral tannages, the most prominent used today is chromium sulfate. Zirconium and aluminum are other minerals widely used in tanning. Other natural tannages include aldehyde, which is toxic because it uses formaldehyde, and oil tannage. Oil tannage is primarily used for "chamois" leather. Syntans or synthetic organic tanning agents are also used. Of all these tannages, it is widely believed that "chrome" tannage produces the strongest leather.

For many years various attempts have been made to improve the function and appearance of leathers by changing the methods of tanning and by putting various additives into the tanning mixture during processing. When leather is used for various garments, such as for shoes and gloves, it is desirable that the leather have additional properties that would improve the comfort to the wearer and durability of the leather. For example, leathers have been stain-proofed and waterproofed using various additives. However, there remains a need for improved leather and improved processes for treating leather that provides a thermally enhanced leather, while maintaining the softness, stretchability, resilience, and appearance of the leather.

SUMMARY OF THE INVENTION

One object of the present invention is to provide an improved leather impregnated with a temperature stabilizing material, such as microspheres containing a phase change material.

Yet a further object of the invention is to provide an improved process for tanning leather for use in garments with microencapsulated phase change material, which provides improved thermal properties to the leather.

The invention is generally directed to a tanned leather including an internal fiber matrix and a plurality of microspheres containing a temperature stabilizing material. The microspheres are embedded within the fiber matrix in a sufficient amount that the microspheres enhance the thermal stability of the leather when subject to heat or cold. The present invention is also directed to leather products formed of such leather, such as garments, shoes, and gloves. This allows such leather products to thermally regulate the temperature of the user.

The present invention is also directed to a method of impregnating a material having an internal fiber matrix. The method comprises the steps of placing the material in a container, adding a tanning agent to the container, combining a plurality of microspheres containing a temperature stabilizing material with a liquid to form a suspension, adding the suspension to the container, and agitating the contents of the container until microspheres are embedded within the fiber matrix. A sufficient amount of the microspheres are embedded so that, the microspheres enhance the thermal stability of the material when subject to heat or cold. In the method, the material to be treated, can be either raw skins or tanned leather.

DETAILED DESCRIPTION OF THE PREFERRED EMBODIMENTS

Leather tanning is an ancient art that has been practiced on a wide variety of materials. The process described and claimed herein can be applied to many raw materials, for example, including but not limited to sheep skin, goat skin, cowhide, deer skin and calf skin. The raw material selected depends upon the application for the final leather produced.

However, all of the raw material includes an internal fiber matrix, which is the dermis skin layer. The dermis consists of bundles of connective fibers which form a three-dimensional "mesh" of connective tissue. The fibers are made of protein.

Figure 1:
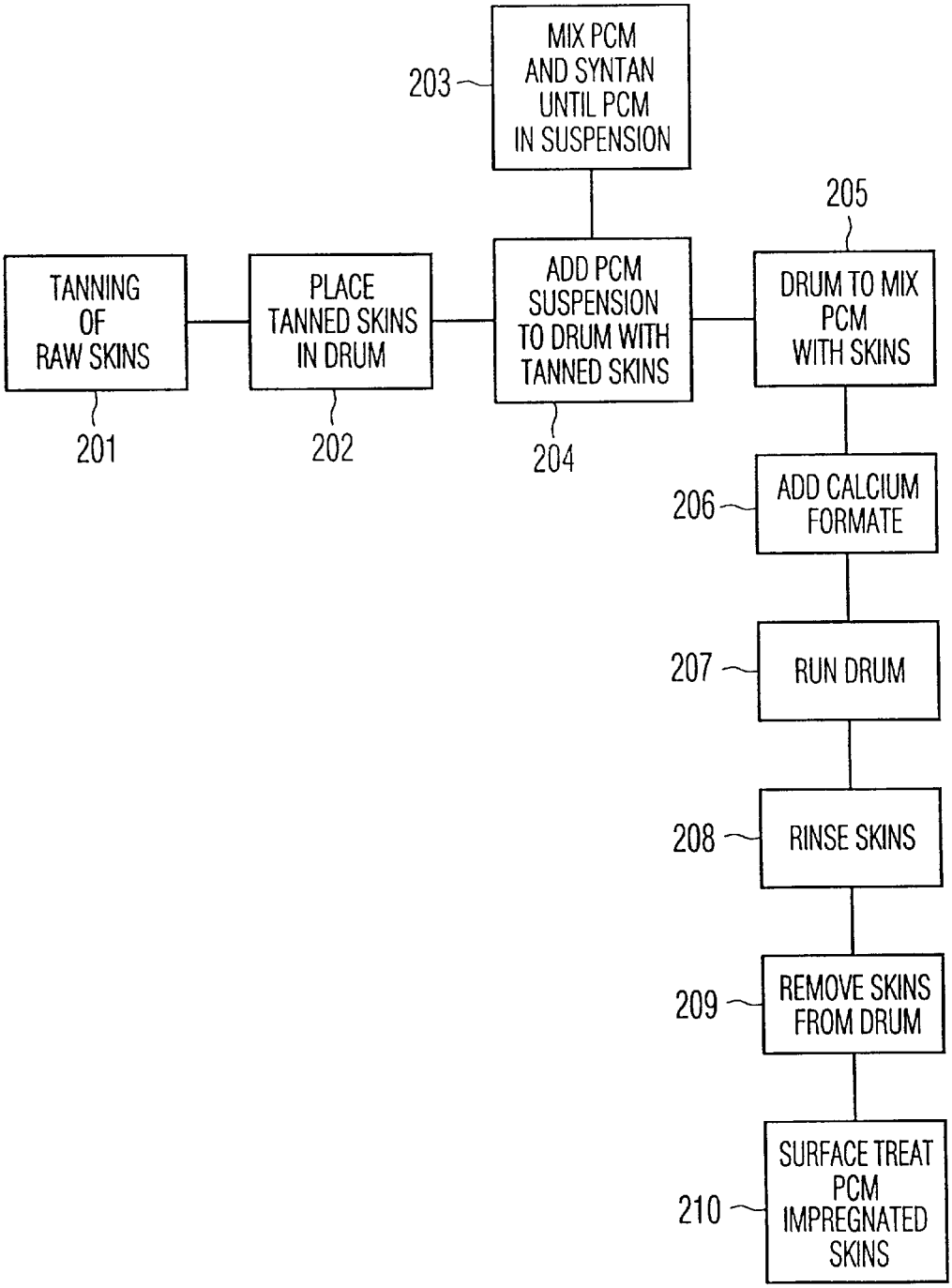
FIG. 1 is a flow chart diagram of a re-tanning process for embedding a temperature stabilizing material into an internal fiber matrix, in accordance with one embodiment of the invention.

In the first embodiment of the method of the present invention, as shown in FIG. 1, in step 201 the raw material is first brought to a fully chrome-tanned state, which imparts permanency to the fiber structure. A typical chrome tanning process described in the Leather Technician's Handbook by J. H. Sharphouse, B.S.c Leather Producer's Association, Kings Park Road, Moulton Park, Northampton, U.K. includes a series of fourteen separate steps, as discussed below.

1. First the skins are soaked in drums running at four revolutions per minute with 300% water at 27° Celsius and adjusted to a pH of 9.0 with 0.1% non-ionic surfactant. The skins are drummed intermittently for a period of six to 12 hours.

2. The skins are then drained.

3. The flesh sides of the skins are painted with 15% sodium hydrogen sulphide (33% strength), 50% hydrated lime and 35% water. The skins are allowed to pile overnight and then the wool is removed.

4. Next, 600% water and 12% lime are placed in a vat with agitating paddles run five minutes every four hours for 24 hours. Then ½% sodium sulphide is added to the vat and the agitating is continued for an additional 12 hours.

5. Next, the flesh is removed from the back side of the skin with a rotary fleshing machine.

6. Next, the skin is washed in soft, running water in a paddle vat for 30 minutes.

7. The skins are delimed in paddle vats containing 500% water at 37° Celsius with 1.5% ammonium chloride where the paddles are run for 60 minutes or until the skins re free of lime.

8. The bating process includes the addition of 1% bacterial bate with the addles run for two to three hours.

9. Next the skins are pickled in a drum with the pickling liquor being formed of 200% water at 20° Celsius, 20% salt and 2% sulfuric acid. The drum is run for 60 minutes, with the final pickle liquor strength being a 0.5% solution of sulfuric acid. The drum is then drained and the skins are stored for aging for several days.

10. The Chrome tanning solution is put in the drum. The tanning solution includes 100% water, 5% salt, 1% chromic oxide (as 10% of chrome liquor of 11% chromic oxide and 33% basicity, $SO_2$ reduced) and then 1% chromic oxide (as 10% of the above chrome liquor). The skins are then drummed for from two to six hours in this mixture until penetrated.

11. The skins are then basified. To complete the tannage ½–1% sodium bicarbonate should be added carefully over four hours and then a shrinkage temperature test should be taken. At the completion of tannage, the pH should be approximately 4.4 and the shrinkage temperature 98° Celsius.

12. The skins are then piled and drained for 24 hours.

13. Then the skins are neutralized thoroughly in the drum with 150% water and 1½% ammonium bicarbonate. The drum is run for 60 minutes to give a pH throughout the skin of 5.5–6.0.

14. Finally, the skins are washed well, at which point the leather is fully chrome tanned and ready for the re-tanning by the impregnation process of the present invention.

The chrome tanning process described above is well known in the art. It is merely provided as a representative description of the primary tanning process performed on the raw skins prior to the re-tanning process for impregnation of the thermal stabilizing material of the present invention. Other chrome tanning processes or even other basic mineral or vegetable tanning processes can be utilized as the preliminary tanning preparatory to the use of the impregnation process. Chromium sulfate, zirconium and aluminum mineral primary tannages may also be utilized with the present invention.

Figure 2:
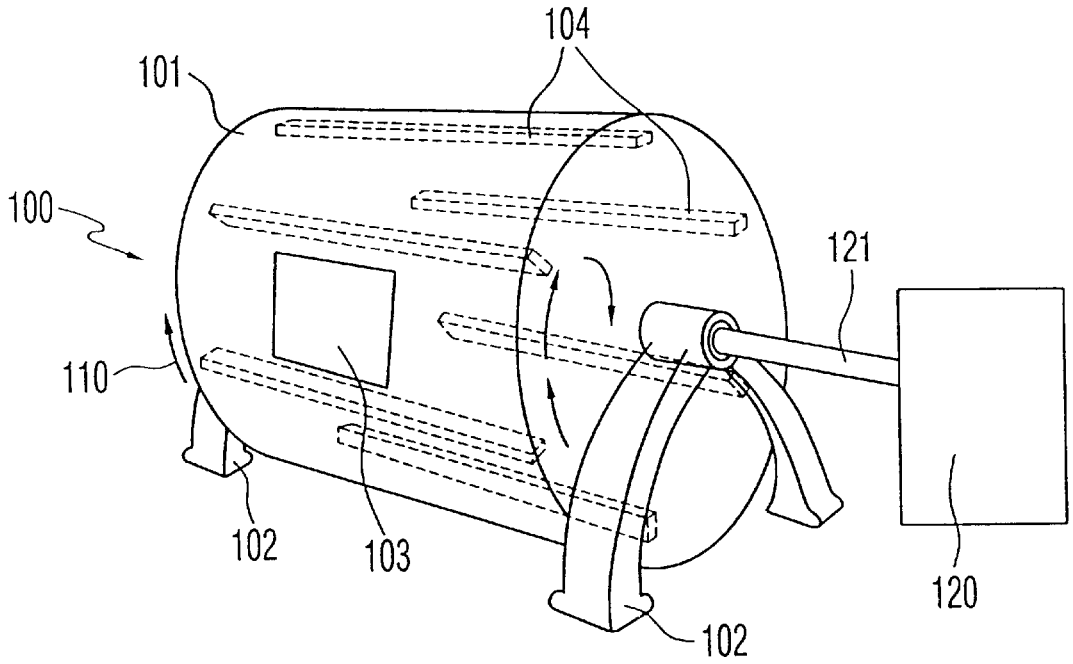
FIG. 2 is a perspective view of a rotating drum for embedding the temperature stabilizing material into the matrix, in accordance with the invention.

The re-tanning impregnation will now be discussed, with reference to FIGS. 1 and 2. In step 202, the chrome tanned skins are placed in a rotating re-tanning drum 100.

The rotating drum 100 is a container for use in leather treatment processes and can be replaced with other conventional containers such as a pit. The drum 100 includes a wooden drum portion 101, supported on legs 102 for rotation about a horizontal axis as shown by arrow 110. A motor 120 is used with linkage 121 to drive the rotation of drum portion 101. Motor 120 and linkage 121 are conventional elements. Drum portion 101 also includes a flap 103 adapted to open when the skins are to be added or removed from drum 101 and to seal tightly when the re-tanning process is underway. Drum portion 101 also includes interior baffles 104 used to mix the skins with the various liquids used in the re-tanning process and to prevent skins sticking to each other. The wooden drum is well known in the tanning and re-tanning arts and can be used for a primary tanning process as well.

Turning again to FIG. 1, in step 203, water at a predetermined temperature, an appropriate syntan, and a temperature stabilizing material, which is microencapsulated phase change material (PCM), are premixed. Syntans such as gluteraldehyde solution, formaldehyde, phenols and napthalenes for example may be utilized. The amounts of each of these components, the temperature, and mixing procedures are readily determinable by one of ordinary skill in the art. The premixing of the syntan and microencapsulated phase change material has the purpose of suspending the microencapsulated phase change material in a liquid suspension, which will carry the phase change material into a deep penetration of the internal fiber matrix of the skins.

The amount of microencapsulated phase change material utilized varies depending upon the physical characteristics of the skins being re-tanned, the primary tanning process utilized, and the thermal properties desired. The amount of the thermal material present after this process is complete should be sufficient to allow the microspheres to enhance the thermal stability of the leather when subject to heat or cold. The recommended amount of this material is about 3% or greater by weight of the leather, and more preferably between about 3% to about 15%.

Where a sufficient amount of the microencapsulated phase change material is utilized, the full benefits of the thermal capabilities and characteristics of the microencapsulated phase change material are achieved without the material leaving the leather's internal matrix.

The temperature stabilizing material is within a microcapsule. The microcapsules can range in size from about one to about several 100 microns in diameter and are formed according to the methods described in any one of the following texts to which the reader is referred for an explanation on how to fabricate microcapsules:

Books on Microencapsulation:

1. Vandergaer, J. E., Ed: Microcncapsulation: Processes and Applications. Plenum Press, New York, 1974.
2. Gutcho, M. H.: Microcapsules and Microencapsulation Techniques. Noyes Data Corp., Park Ridge, N.J., 1976.
3. Ranney, M. W.: Microencapsulation Technology, Noyes Development Corp., Park Ridge, N.J., 1969.
4. Kondo, A.: Microcapsule Processing and Technology. Marcel Dekker, Inc., New York, 1979.
5. Nixon, J. R.: Microencapsulation. Marcel Dekker, Inc., New York, 1976.

Articles on Microencapsulation:

1. Sparks, R. E.: "Microencapsulation", Kirk-Othmer Encyclopedia of Chemical Technology, Vol. 15, 3rd Edition, John Wiley and Sons, Inc., 1981.
2. Thies, C.: "Physicochemical Aspects of Microencapsulation," Polym. Plast. Technol. Eng., Vol. 5, 7 (1975).
3. Thies, C.: "Microencapsulation", McGraw-Hill Yearbook of Science and Technology, 1979, pp. 13–21.
4. Herbig, J. A.: "Microencapsulation", Encyclopedia of Polymer Science and Technology, Vol. 8, 719 (1968).

The temperature stabilizing material within the microcapsules is a phase change material, such as cicosane, or plastic crystals. Plastic crystals, such as 2,2-dimethyl-1,3-propanediol (DMP) and 2-hydroxymethyl-2-methyl-1,3-propanediol (HMP) and the like may be used. When plastic crystals absorb thermal energy, the molecular structure is temporarily modified without changing the phase of the material. In another aspect of the invention, the composition of the phase change material may be modified to obtain optimum thermal properties for a given temperature range. For example, the melting point of a homologous series of paraffinic hydrocarbons is directly related to the number of carbon atoms as shown in the following table:

| Compound Name | Number of Carbon Atoms | Melting Point Degrees Centigrade |
|---|---|---|
| n-Octacosane | 28 | 61.4 |
| n-Heptacosane | 27 | 59.0 |
| n-Hexacosane | 26 | 56.4 |
| n-Pentacosame | 25 | 53.7 |
| n-Tetracosane | 24 | 50.9 |
| n-Tricosane | 23 | 47.6 |
| n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |
| n-Tridecame | 13 | −5.5 |

Each of the above materials can be separately encapsulated and is most effective near the melting point indicated. It will be seen from the foregoing that the effective temperature range of the leather can, therefore, be tailored to a specific environment by selecting the phase change materials required for the corresponding temperature and adding microcapsules containing the material to the leather.

In addition, the leather can be designed to have enhanced thermal characteristics over a wide range of temperature or at discrete temperature ranges through proper selection of phase change material.

Referring again to FIG. 1, in step 204, the microencapsulated phase change material suspension is added to the drum 100 containing the tanned skins. In step 205, the rotating drum is run, which mixes and agitates the skins, until the microencapsulated phase change material suspension penetrates the internal fiber matrix of the tanned skins.

Next, in step 206, an agent such as Calcium Formate is added to the drum, which is conventionally used in tannage processes. In step 207, the drum is again rotated to allow good distribution of the Calcium Formate around the skins. The drum is run for a predetermined period of time.

Finally, in step 208 the drums are rinsed at a predetermined temperature for a predetermined time. At this point the suspended microencapsulated phase change material has fully penetrated the fiber matrix of the skins and is embedded within the matrix. In some cases the material can bond with the fibers.

The re-tanned leather has microencapsulated phase change material within the internal fiber matrix of the leather in an amount sufficient to produce the thermal properties desired in response to heat or cold.

Figure 3:
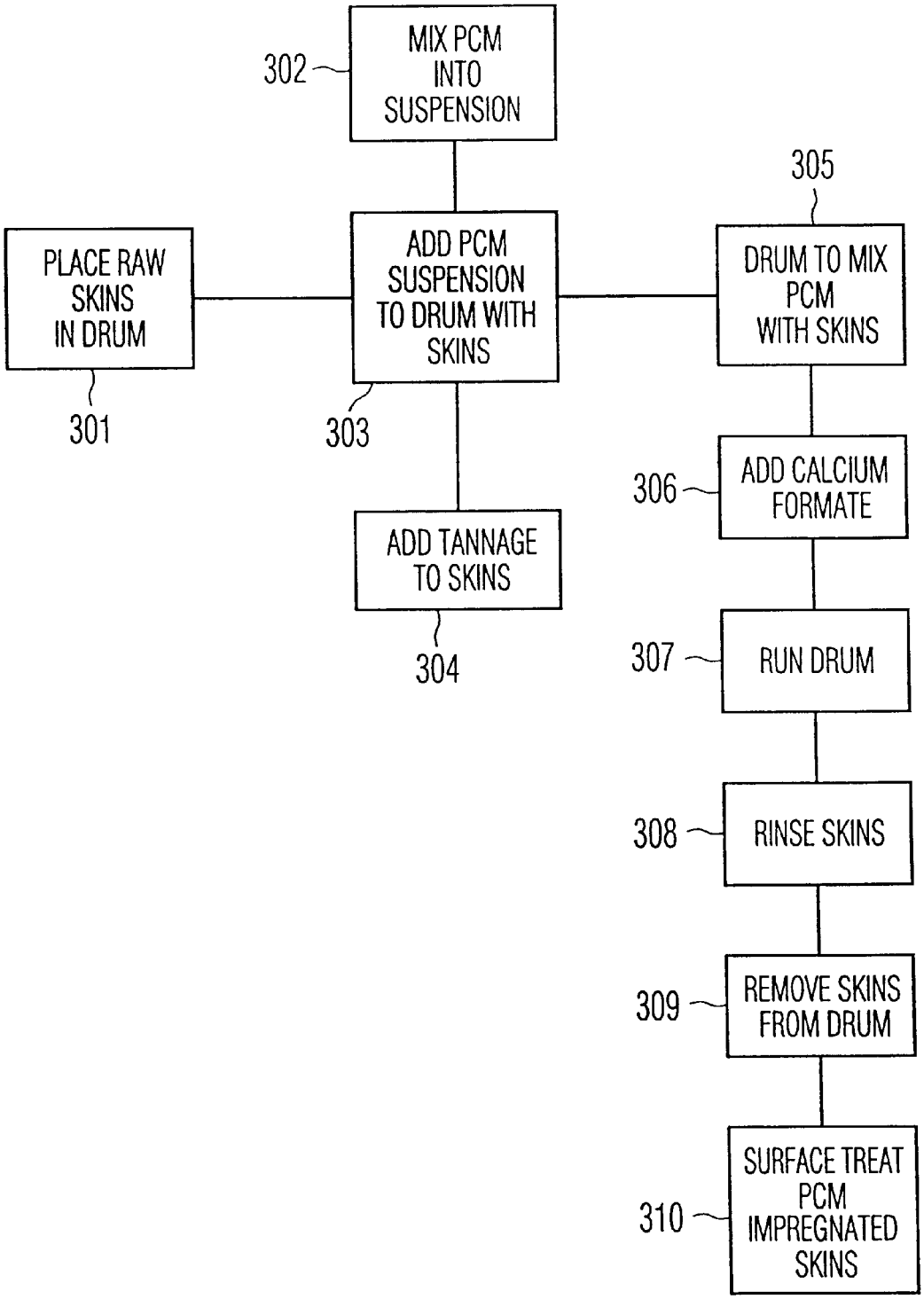
FIG. 3 is a flow chart diagram of a tanning process for embedding the temperature stabilizing material into the matrix, in accordance with an alternative embodiment of the invention.

Referring to FIG. 3, a second embodiment of the method of the present invention is diagramed. In this embodiment microencapsulated phase change material is impregnated into the leather during the primary tanning process. In step 301, the raw skins are placed in a drum. In step 302, the microencapsulated phase change material is mixed with a liquid to form a suspension. This mixture can include a tanning agent such as chrome or other mineral tannin, a vegetable tannin or a syntan or a combination of these. Once the suspension is formed, in step 303 the suspension is added to the drum. In step 304, a tannage is added to the drum. The tannage can be added before or after the phase change material. If the suspension has sufficient tanning agent within it, this separate tannage step can be removed. Prior to steps 302 and 304, the skins can be prepared in the customary manner as discussed above to remove the hair, flesh, and prepare the skins for tanning.

Steps 305–310 are similar to steps 205–210, which allow the suspension to penetrate the fiber matrix of the skins until the microencapsulated phase change material is embedded therein. These steps also include rinsing, draining and treating the surface of the skins as known by one of ordinary skill in the art. As a result, the second embodiment allows the microencapsulated phase change material to be impregnated into the leather during the primary tanning process. This primary tanning can be followed up by a re-tanning that includes additional microencapsulated phase change material or without this additional phase change material depending on the concentration of phase change material achieved during primary tanning.

In accordance with the processes disclosed above, the microencapsulated phase change material is able to impregnate the entire leather product so that their unique thermal properties are within the leather, which are sustained permanently.

Leather with embedded microencapsulated phase change material is particularly suitable for use in a variety of leather products, including but not limited to clothing, wearing apparel, sporting goods, home furnishings, vehicles, bags, watch bands as well as other applications where an individual is exposed to different temperatures. The leather is also suitable for use in wearing apparel like dress or specialty/sports gloves, shoes, elbow guards, knee guards and other similar bracing materials, and watch bands, etc.

Figure 4:
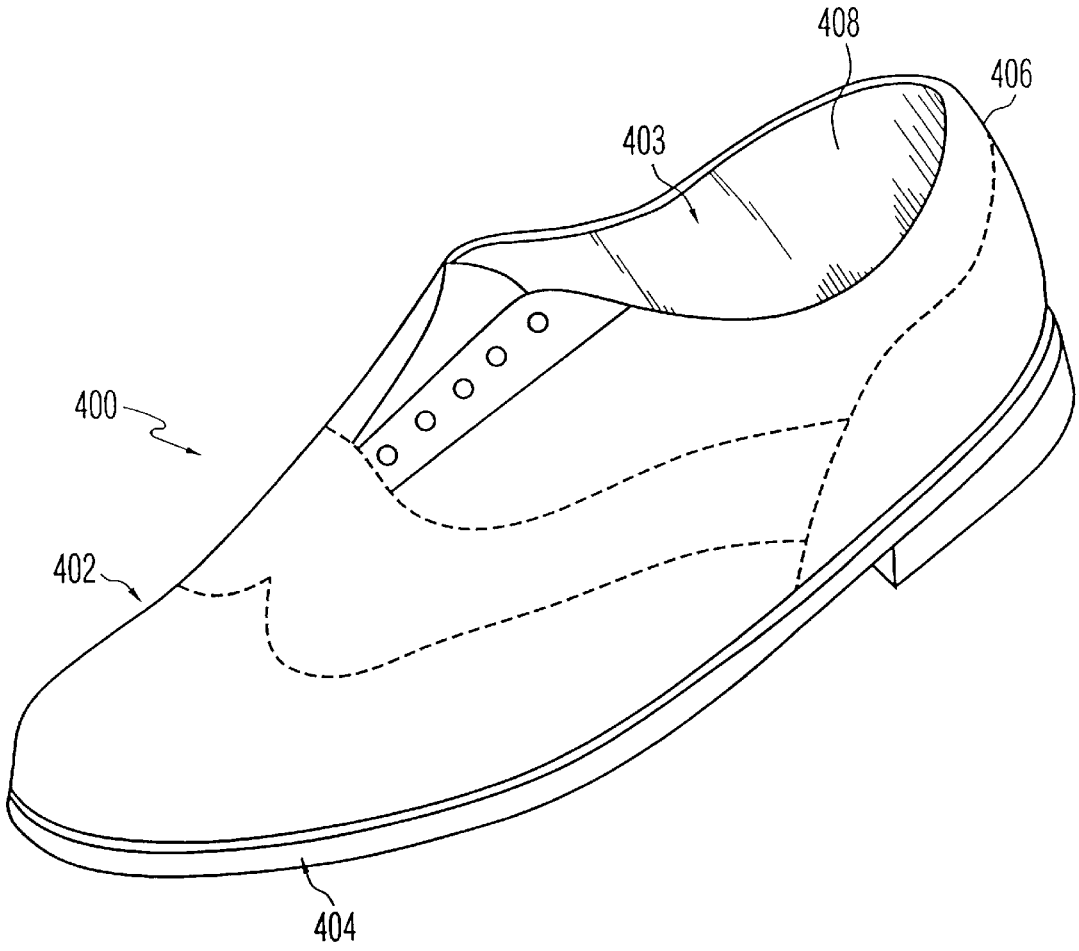
FIG. 4 is a perspective view of a golf shoe formed of the leather of the present invention.

This material is particularly suited for making sports shoes, such as a golf shoe 400 shown in FIG. 4. The golf shoe 400 includes an upper 402 joined in a conventional fashion to an outsole 404. The upper and outsole form an opening 403 for receiving a user's foot. The upper 402 includes an external layer 406 and an internal layer or lining 408. The lining can be formed of the leather of the present invention, which has a temperature stabilizing material embedded therein. By choosing an appropriate phase change material, the shoes can be adapted for cold or warm weather use. The heat from the user's foot can liquify the phase change material thus cooling the user's foot. If the user's foot is cold, the material can solidify to warm the users' foot. Thus, the user can remain comfortable regardless of the ambient temperature. By incorporating the temperature stabilizing material into the lining, the appearance and fit of the shoe are not affected. The closer this material is to the wearer's skin the better the performance. The preferred microspheres used for golf shoe application is a powder called THERMASORB® 83, which is available from Frisby Technologies of Freeport, New York. Other THERMASORB® formulations made by Frisby Technologies are recommended for activation at higher or lower temperatures.

Leather with microencapsulated phase change material can also form the external layer 406. This leather can also be placed at various other locations of the shoe including the tongue. This leather can also be combined with thermally enhanced foam or fabric located in other areas of the shoe, such as the insole, tongue, and the collar surrounding the opening so that the surface area of wearers' foot in contact with thermally enhanced materials is maximized.

Figure 5:
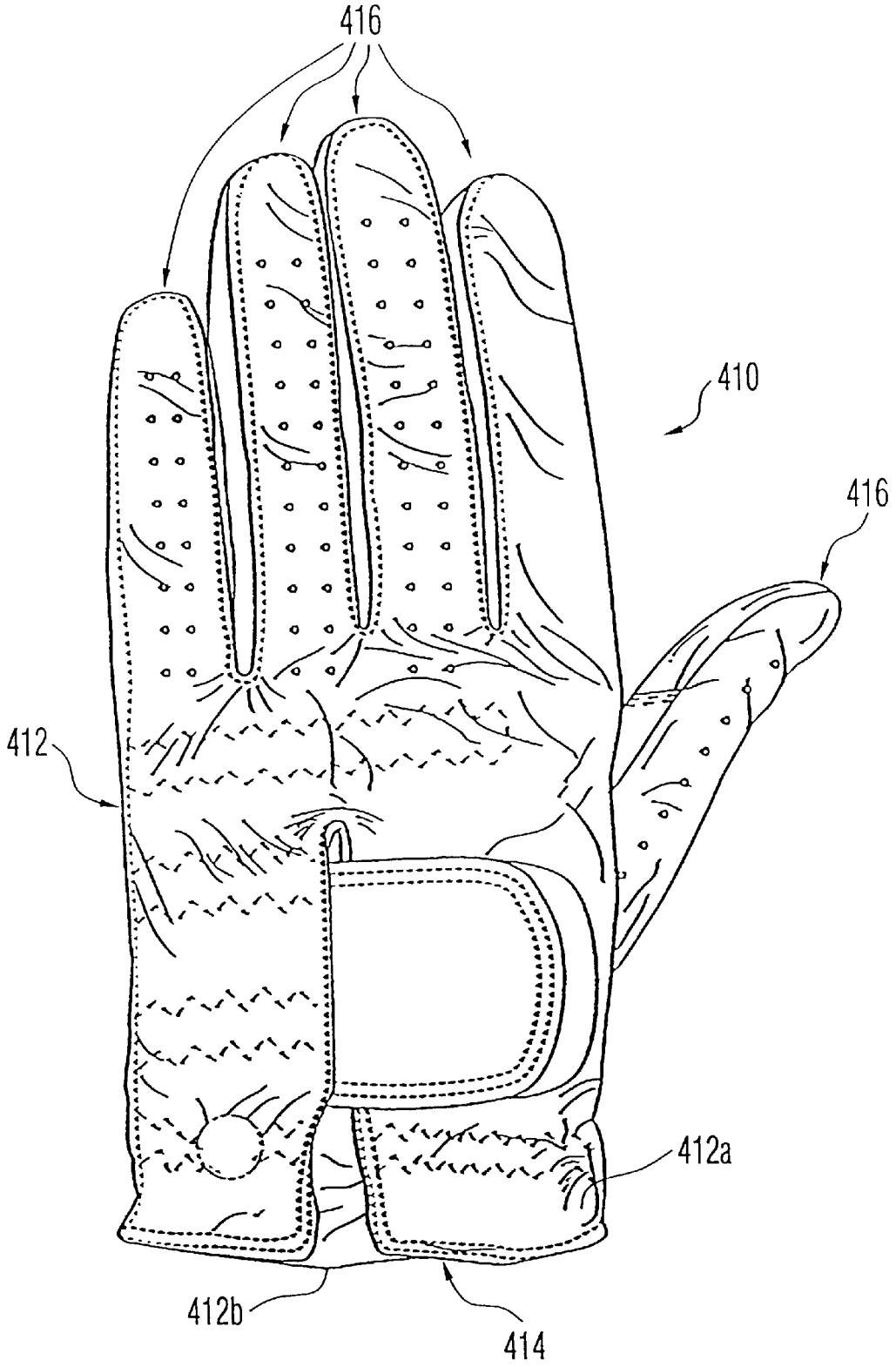
FIG. 5 is a front view of a golf glove formed of the leather of the present invention.

This material can be used to form various types of sports gloves, including golf, bicycle, baseball/softball, weight lifting gloves and the like. Turning to FIG. 5, a golf glove 410 is shown which is formed in a conventional manner to include a body 412 having two panels, which are front panel 412*a* and rear panel 412*b*. The body defines an opening 414 for receiving a user's hand and a plurality of finger casings 416. The thumb casing can be formed integral with the body or as a separate component. The leather of the present invention can be used to form one or both panels 412*a*, 412*b* of the body to keep the wearer's hands at a comfortable temperature.

While it is apparent that the illustrative embodiments of the invention disclosed herein fulfill the objectives stated above, it is appreciated that numerous modifications and other embodiments may be devised by those of ordinary skill in the art. For example, the Calcium Formate can be removed from the processes or substituted with a similar agent. In addition, the processes can further include impregnating the leather with other additives, such as dyes, etc. as known by those of ordinary skill in the art. Therefore, it will be understood that the appended claims are intended to cover all such modifications and embodiments which would come within the spirit and scope of the present invention.

What is claimed is:

1. A tanned leather comprising:

an internal fiber matrix;

a plurality of microspheres containing a temperature stabilizing material, said microspheres being disposed and embedded within the fiber matrix in a sufficient amount so that the microspheres enhance the thermal stability of the leather when subject to heat or cold.

2. The leather of claim 1, wherein the temperature stabilizing material is a phase change material.

3. The leather of claim 1, wherein the temperature stabilizing material is a plurality of plastic crystals.

4. The leather of claim 1, wherein the amount is about 3% to about 15% by weight.

5. The leather of claim 1, wherein the microspheres are bonded to the internal fiber matrix.

6. The leather of claim 1, wherein it is incorporated in a product selected from clothing, gloves, or shoes.

7. The leather of claim 1, wherein the leather is a leather product in a vehicle.

8. The leather of claim 1, wherein the leather is incorporated into an article of furniture.

9. The leather of claim 6, wherein the leather is incorporated into a shoe.

10. The leather of claim 9, wherein the leather is incorporated into a tongue of a shoe.

11. The leather of claim 9, wherein the leather is incorporated into an insole of a shoe.

12. A method of impregnating a material selected from skins and hides, wherein the method comprises the steps of:

placing the material in a container;

adding a tanning agent to the container;

combining a plurality of microspheres containing a temperature stabilizing material with a liquid to form a suspension;

adding the suspension to the container; and agitating the contents of the container until a portion of the micorspheres are disposed and embedded within the fiber matrix so that the microspheres enhance the thermal stability of the material when subjected to head or cold.

13. The method of claim 12, wherein the material is raw skins.

14. The method of claim 12, wherein the material is tanned skins.

15. The method of claim 12, wherein the container is a rotating drum.

16. The method of claim 12, wherein the temperature stabilizing material is a phase change material.

* * * * *

UNITED STATES PATENT AND TRADEMARK OFFICE

CERTIFICATE OF CORRECTION

PATENT NO. : 6,179,879 B1

DATED : January 30, 2001

INVENTOR(S) : ROBINSON et al.

It is certified that error appears in the above-identified patent and that said Letters Patent is hereby corrected as shown below:

Column 8, line 26, delete "micorspheres" and insert --microspheres--.

Column 8, line 28, delete "head" and insert --heat--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*